United States Patent [19]

Buck

[11] 4,018,063

[45] Apr. 19, 1977

[54] APPARATUS AND METHOD FOR PRODUCING MESHWARE

[76] Inventor: Alfred Buck, 7401 Hailfingen, Germany

[22] Filed: Feb. 24, 1975

[21] Appl. No.: 552,263

[30] Foreign Application Priority Data

Feb. 25, 1974 Germany ..... 2408924

[52] U.S. Cl. ..... 66/90; 66/104

[51] Int. Cl.[2] ..... D04B 35/00

[58] Field of Search ..... 66/90, 104, 1 R, 8, 66/13, 27, 57, 107

[56] References Cited

UNITED STATES PATENTS

| | | | |
|---|---|---|---|
| 1,424,725 | 8/1922 | Howie et al. | 66/8 |
| 2,090,500 | 8/1937 | Lawson | 66/107 |
| 2,535,991 | 12/1950 | Stevens | 66/57 X |
| 3,192,742 | 7/1965 | Haddad | 66/57 |
| 3,435,636 | 4/1969 | Lindner et al. | 66/57 |
| 3,832,867 | 9/1974 | Luchi | 66/13 X |
| 3,934,431 | 1/1976 | Westmoreland, Sr. | 66/90 X |

FOREIGN PATENTS OR APPLICATIONS

| | | | |
|---|---|---|---|
| 1,323,158 | 2/1963 | France | 66/8 |
| 2,159,865 | 8/1972 | Germany | 66/90 |
| 1,248,215 | 8/1967 | Germany | 66/104 |
| 2,025,144 | 12/1970 | Germany | 66/104 |
| 499,866 | 1/1939 | United Kingdom | 66/90 |
| 287,298 | 3/1928 | United Kingdom | 66/104 |

*Primary Examiner*—Mervin Stein
*Assistant Examiner*—A. M. Falik
*Attorney, Agent, or Firm*—Cushman, Darby & Cushman

[57] ABSTRACT

An apparatus for producing meshware, comprises a needle cylinder carrying a plurality of needles with sinkers therebetween, the needles and the sinkers both being movable so that one part of a stitch is made up by movement of the needles and the remainder of the stitch is made up by movement of the sinkers.

The method of producing the meshware is also included.

10 Claims, 4 Drawing Figures

FIG. 1
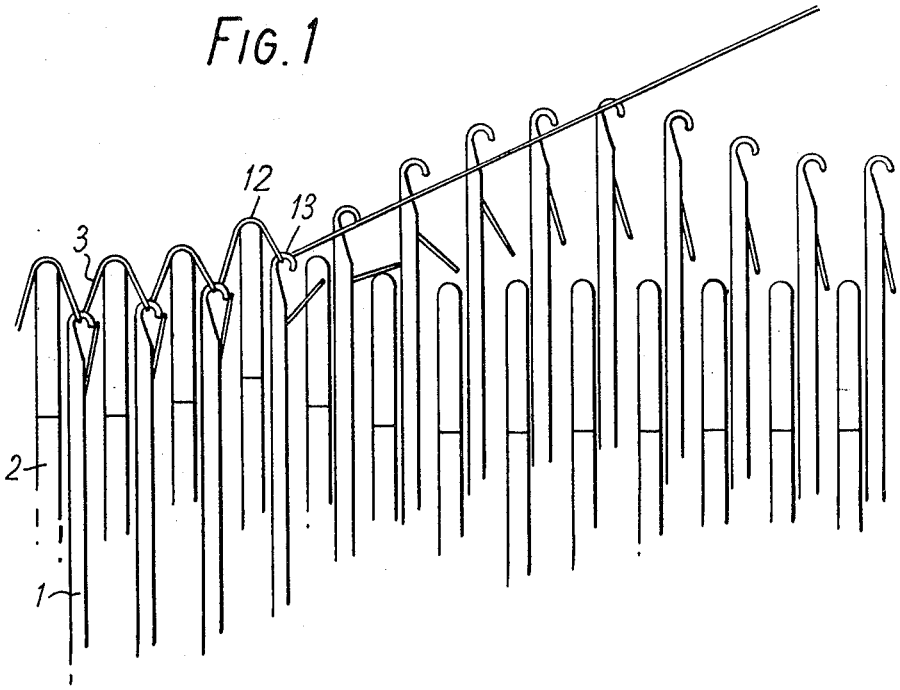
FIG. 2a
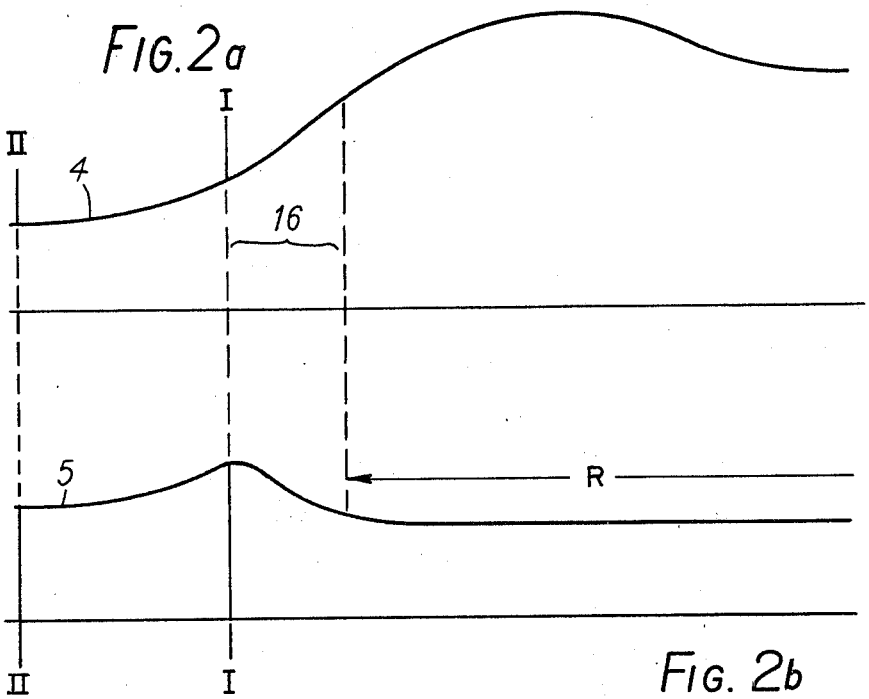
FIG. 2b

APPARATUS AND METHOD FOR PRODUCING MESHWARE

BACKGROUND OF THE INVENTION

The invention relates to apparatus for and a method of producing meshware through the agency of needles movable in a cylinder, a sinker being disposed between every two needles parallel thereto.

In one known apparatus or device of this kind, only the needles move, the sinkers remaining stationary. Machines of this kind have, for instance, a stationary cylinder and a rotatable cambox provided with the needle cam. A yarn or a metal wire is fed to the needles. Preferably, the needles are latch needles. Stitch length depends upon the depth or extent of the draw — i.e. upon the maximum distance between the needle hook of the needle in its lowest position and the sinker endface over which the yarn is drawn. The needles have butts which are guided and actuated in a cambox trick. The trick serves as the cam for the needles which are distributed around the periphery of the cylinder and which are pushed out to the maximum extend to take up yarn from the needle trick, and then descend for stitch-forming. This vertical needle motion is produced, as the cambox or cylinder rotates, by means of the trick and the needle butts guided therein.

As a rule, the depth of draw in the production of meshware is determined by the wishes of clients; consequently, the cam has a predetermined rise which the needle butts have to carry out once or several times during each revolution. Clearly, the pressure of the needle butts on the trick wall when the machine operates is greater in proportion as the cam is steeper and as the machine runs faster. However, the machine is required to run fast since the speed of machine operation directly governs the output of end product. Unfortunately, the maximum speed of the machine is limited by cam steepness, for if speed is excessive the pressure of the needle butts on the trick wall becomes excessive and the needle butts break.

SUMMARY OF THE INVENTION

It is an object of the invention to provide an apparatus and a method enabling the speed of production to be increased beyond existing values without overloading the needles, thus increasing output.

According to a first aspect of the invention, there is provided apparatus for producing meshware comprising a needle cylinder, a plurality of needles in said needle cylinder and movable through a distance necessary during stitching, to form a first part of a stitch and a plurality of sinkers positioned between needles and movable through a distance necessary, during stitching, to form the remaining part of said stitch.

According to a second aspect of the invention, there is provided a method for producing meshware comprising moving a plurality of needles in a needle cylinder a distance to form a first part of a stitch and moving a plurality of sinkers between said needles a distance to form the remaining part of said stitch.

BRIEF DESCRIPTION OF THE DRAWINGS

The invention will now be described in greater detail, by way of example, with reference to the drawings, in which:

FIG. 1 shows the motion of needles and sinkers in the form of a developed view of the periphery of a cylinder with the associated needles and sinkers, the number of needles shown being considerably reduced so as not to overload the drawing, the needles being shown at a 90° offset from their actual position so as to show the position of the latch clearly;

FIG. 2*a* shows the needle cam;

FIG. 2*b* shows the sinker cam, and

DESCRIPTION OF THE PREFERRED EMBODIMENTS

Figure 3:
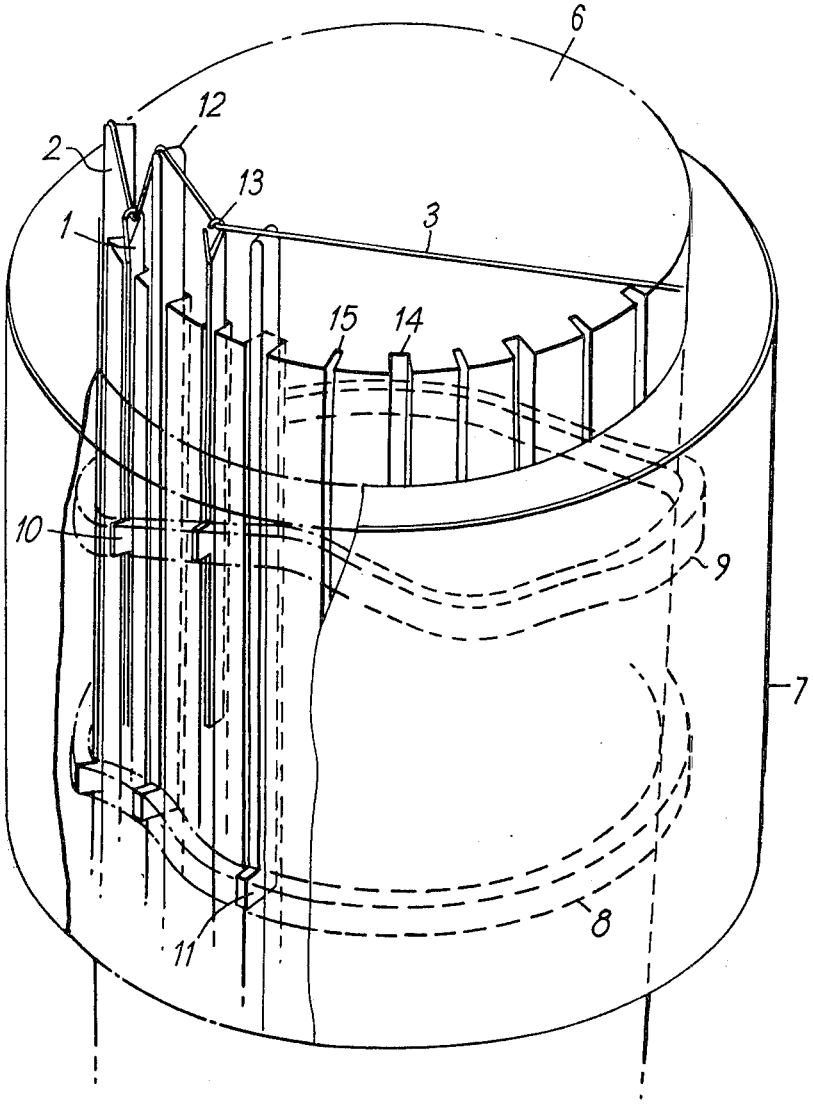
FIG. 3 is a perspective view of the main items of the machine, on the assumption that the cambox is transparent so that the various tricks can be seen.

Basically, the invention proposes that, in a method of producing meshware through needles movable in a cylinder with sinkers between every two needles and parallel thereto, during stitching, the sinkers are moved in or oppositely to the direction of movement of the needles, and the distance necessary to form a stitch is covered to some extent by the yarn-drawing needle and for the remainder by the sinker.

The invention therefore proceeds from the realisation that some of the draw can arise from a sinker movement which is simultaneous with, but oppositely directed to, needle movement. The sinker therefore moves oppositely to the needle during the descent thereof, whereafter the stitch length —i.e. the depth or extent of the draw — is determined by the maximum distance between, on the one hand, the sinker end face over which the yarn is drawn and, on the other hand, the needle hook which is below the sinker end face.

This method requires two separate cams, one for the needles and one for the sinkers.

The advantage of the method according to the invention is that cam steepness can be reduced for a given draw; the speed of machine operation can therefore be increased considerably without any risk of overloading and therefore breaking the needles. It was found with one machine that its speed of operation could be increased from a previous macimum of 200 R.P.M. to 300 R.P.M. — in other words a 50% increase.

In an apparatus or device of the kind according to the invention, the cams for guiding the needle and sinker butts are contrived in the cambox, the same extending around the cylinder which is formed with tricks to receive the moving needles and sinkers.

It has been found with an advantageous embodiment of the device according to the invention that optimum results can be achieved by dividing the travel or movement between the needle and the sinker in the proportion of 3 for the needle to 1 for the sinker. So that the travel — i.e. the draw — can be subdivided, the sinker cam rises in the descending and steepest part of the descent region of the needle cam. In one embodiment of a machine, maximum needle cam steepness is between 45° and 48°.

Referring now to the drawings, the various positions taken up by the needles and sinkers during one rotation of the cam — i.e. of the cylinder — are shown from right to left in FIG. 1. For example, in a form of machine of use for producing a wire mesh structure, the cylinder has 132 needles and 132 sinkers needle diameter being 12 inches. First, the needles 1 rise with their latches open to receive yarn 3. When the yarn has been inserted below the hook 13 of the needle, the needle descends. During this first phase of needle movement the sinker 2 remains virtually stationary, (in its rest position R), as can be seen in FIG. 2. Only in the steepest zone 16 (FIGS. 2*a*, 2*b*) of the descending needle cam 4 do the sinkers 2 move oppositely to the needle to take up a loop forming position I, the yarn being drawn over sinker end face 12. Stitch length is therefore determined by the depth or extent of draw or the maximum distance between the sinker end face 12 above and the needle hook 13 below it.

When the required draw has been provided, the needles and sinkers both descend in the same direction to the stitch forming position II to initiate knitting. Stitch length is therefore maintained. As a comparison of the needle cam 4 (FIG. 2*a*) with the sinker cam 5 (FIG. 2*b*) will show, the sinker travels approximately one-third of the distance travelled by the needle. Since sinker movement becomes operative in the steepest part of the needle cam, the needle cam can be less steep than it would have to be in the case of a stationary sinker. The rises of both cams are shown substantially true to scale in FIGS. 2*a* and 2*b* but the total length of the cams is shown to a reduced scale. The needle cam rises slowly again after the left-hand end until the needle has reached the height at the right-hand end of the cam. The ends of the sinker cam must merge ito one another correspondingly since the closed cams are distributed over the periphery of a cylinder.

The cams of FIGS. 2*a* and 2*b* occur again in the envelope curves of the needles 1 and sinkers 2 in FIG. 1.

In FIG. 3 there can be seen the cylinder 6 whose periphery is formed with alternate needle tricks 15 and sinker tricks 14. Extending around cylinder 6 is a cam box 7, for instance, in the form of two or more shell-like members which are joined together. Preferably, the cylinder remains stationary and the cam box rotates. To this end, the cam box can have secured to it, for instance, a toothed ring engageable by the drive gear of a motor. These drive elements are not shown in the drawing so as not to overload it.

In FIG. 3 the needle tricks and the sinker tricks are indicated by chain lines and dotted lines respectively. They take the form of grooves in the cam box inside wall. The needle butts 10 are guided in cam track 9 and the sinker butts 11 are guided and retained in cam track 8. The pattern of the cams is also indicated in FIG. 3. Clearly, the sinker cam rises in the descent zone of the needles to trigger off the opposite gaiting described of the needle and the sinker.

FIG. 3 shows how yarn is supplied to the needles and how the needles and sinkers are disposed in parallel relationship to one another in their tricks.

It has been found that the method according to the invention and the associated machine can be used with great advantage in the production of wire mesh structures for use, e.g. as oil filters for motor vehicles or other driven appliances. The increased speed of operation helps to increase output per unit of time and to reduce production costs.

It will be understood that the above description of the present invention is susceptible to various modification changes and adaptations.

What is claimed is:

1. An apparatus for producing meshware comprising a needle cylinder, a plurality of needles in said cylinder movable longitudinally therein in a first direction between a first position in which they accept yarn and a second position in which a stitch is formed, a plurality of sinkers positioned between said needles and movable longitudinally and parallel to said needles and cam means including a first cam surface defining a first smooth curve adapted for smoothly moving said needles between said first and second positions and a second cam surface defining second smooth curve adapted for moving said sinkers in a second direction from a rest position into a loop forming position and thereafter moving said sinkers in said first direction into a stitch forming position in which a stitch is formed with the said movements of said sinkers in said second and first directions from said rest position through said loop forming position to said stitch forming positon taking place during movement of said needles from said first position to said second position.

2. Apparatus as defined in claim 1, wherein said needle cylinder defines a plurality of first tricks each for guiding one of said needles and a plurality of second tricks alternating with said first tricks and each for guiding one of said sinkers.

3. Apparatus as defined in claim 2, and comprising a cam box provided with said first and second surfaces and extending around said cylinder for engagement of said first and second cam surfaces with butts on said needles and on said sinkers respectively.

4. Apparatus as defined in claim 3, wherein said first and second cam surfaces comprise cams designed to give a needle and sinker travel ratio of 3:1 with a rise in said second cam surface for moving said sinkers between said rest position and said loop forming position corresponding to the steepest descending portion of said first cam surface occuring during a descending portion of said first cam for moving said needles from said first to said second position.

5. Apparatus as defined in claim 4, wherein said first cam surface has a maximum steepness of approximately 45° to 48°.

6. Apparatus as defined in claim 4, and comprising a stationary needle cylinder, and a rotatable cam box.

7. Apparatus as defined in claim 2, wherein said sinkers comprise rods each movable in said second tricks and having a radiused end for engagement with the yarn.

8. A method for producing meshware comprising smoothly moving a plurality of needles longitudinally in sequence in a needle cylinder in a first direction from a first position in which they accept yarn into a second position in which a stitch is formed, and smoothly moving a plurality of sinkers between said needles in a second direction from a rest position into a loop forming position and in said first direction from thence into a stitch forming position in which a stitch is formed with said movement of said sinkers in said second and first directions from said rest position through said loop forming position into said stitch forming position taking place during movement of adjacent ones of said needles from said first position to said second position.

9. A method as defined in claim 8, and comprising moving said sinkers upwardly and downwardly during a descent of said needles with said stitch length being determined by the maximum distance between a sinker end face over which mesh yarn is drawn and a needle hook which is below said sinker end face after descent of said needle.

10. An apparatus for producing meshware comprising a needle cylinder, a plurality of needles in said cylinder and movable longitudinally therein between a yarn accepting position and a stitch forming position, a plurality of sinkers disposed between said needles and movable longitudinally and parallel to said needles, cam means including a first cam surface over and in contact with which said needles move, said first cam surface being smoothly curved to move said needles from said yarn accepting position to said stitch forming position in a given direction, said cam means further including a second cam surface over and in contact with which said sinkers move, said second cam surface being smoothly curved for moving said sinkers from a rest positon to a loop forming position in a direction opposite to said given direction and thereafter for moving said sinkers in said given direction to a stitch forming position while said needles are moving from said yarn accepting position to said stitch forming position.

* * * * *